United States Patent [19]

Brownson et al.

[11] 4,035,877

[45] July 19, 1977

[54] BUCKLE

[76] Inventors: Ivan F. Brownson, 16425 Otsego St., Encino, Calif. 91316; Eric J. Brownson, 4730 Natick, Sherman Oaks, Calif. 91403

[21] Appl. No.: 613,048

[22] Filed: Sept. 15, 1975

[51] Int. Cl.[2] ..... A44B 13/00; A44B 11/10

[52] U.S. Cl. ..... 24/230 SL; 24/171; 24/196

[58] Field of Search ..... 24/230 SL, 230 CF, 230 SC, 24/230 F, 201 S, 201 CF, 75, 171, 194, 196

[56] References Cited

U.S. PATENT DOCUMENTS

| | | | |
|---|---|---|---|
| 387,398 | 8/1888 | Corcoran | 24/171 X |
| 462,914 | 11/1891 | Pilkington | 24/230 SL X |
| 1,701,970 | 2/1929 | Chaunard | 24/230 SC |
| 2,807,066 | 9/1957 | Honey et al. | 24/75 |
| 3,078,536 | 2/1963 | Bauer | 24/194 |
| 3,251,110 | 5/1966 | Hedu | 24/230 SC |
| 3,430,306 | 3/1969 | Tareau | 24/230 F |
| 3,798,711 | 3/1974 | Cousins | 24/196 X |
| 3,848,299 | 11/1974 | Gray | 24/230 SC |
| 3,928,895 | 12/1975 | Klink | 24/196 |

FOREIGN PATENT DOCUMENTS

| | | | |
|---|---|---|---|
| 961,402 | 11/1949 | France | 24/196 |

*Primary Examiner*—Paul H. Gilliam
*Assistant Examiner*—V. N. Sakran
*Attorney, Agent, or Firm*—Robert E. Geauque

[57] ABSTRACT

A buckle having a male member insertable into a female member, the male member having a rigid portion and the female member having a flexible portion which engages the rigid portion to produce the locking action and the male member has a separate flexible portion which overlies the flexible female portion so that pressure applied to the flexible male portion moves the flexible female portion to unlock the buckle by moving it away from the rigid male portion.

9 Claims, 6 Drawing Figures

BUCKLE

BACKGROUND OF INVENTION

Quick disconnect buckles are utilized in a variety of equipment, such as in safety jackets for water skiers, life vests worn by swimmers, etc., in order to comfortably attach such equipment to the body of the wearer. Generally, it is necessary that such a buckle be easily accessible for release in order to insure the safety of the wearer. Preferable, the buckle should be made of some material such as plastic, which will not be injurious to the body and will not be affected by salt water. The structure of such belts have usually included a male member which is insertable into a female member and one of the members has a flexible part which engages a rigid part of the other member. The buckle is release by applying pressure to the flexible part to disengage the members, such as disclosed in U.S. Pat. No. 3,200,464. With such a construction, it is possible to accidentally apply a release force to the flexible part to release the buckle at an undesirable time. The impact of the buckle with water could produce such a release force since the flexible part is unprotected. Some prior buckle structures have utilized a third member separate from the male and female members in order to release the buckle. Such buckles are complicated in construction and too costly for the equipment with which they are to be associated. Examples of the buckles with separate release members are found in U.S. Pat. Nos. 3,203,065, 3,795,030 and 3,848,299.

SUMMARY OF THE INVENTION

The buckle of the present invention utilizes a male member having a rigid portion and a female member having a flexible portion to produce the locking action and a separate flexible portion of the male member is utilized to unlock the members. During the locking action, the rigid male portion flexes the female portion and is inserted over the flexible female portion until the rigid part becomes engaged in a notch in the inside edge of the flexible female part. When it is desired to release the members, the flexible portion of the male member is forced against the flexible portion of the female member and causes it to move out of engagement with the rigid part of the male member, thereby permitting the male member to be pulled out of the female member. Thus, no separate third part is necessary to release the buckle. The flexible part of the male member overlies the flexible part of the female member when the members are locked together, and therefore protects the flexible female part from accidental front forces which would cause the buckle to release. An accidental force on the inside surface of the flexible female member serves to maintain the locking action. Thus, the buckle is more resistant to unlocking upon sudden accidental impact than are buckles in which a flexible unlocking part is directly subject to such an impact.

DESCRIPTION OF THE PREFERRED EMBODIMENT

Figure 1:
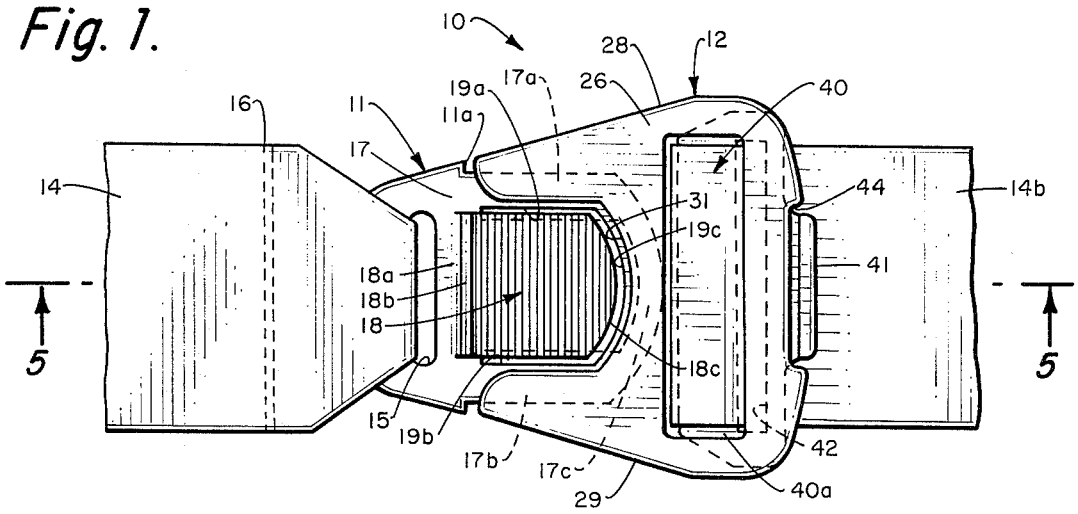
FIG. 1 is a plan view of the front of the buckle of the present invention showing the male and female members connected together.

Buckle 10 comprises a male member 11 and a female member 12 both preferably constructed of a suitable plastic material. A strap 14 is permanently attached to male member 11 by passing end 14a through opening 15 in member 11 and the end is secured to the belt in any suitable manner, such as by stitching 16. Male member 11 comprises basically a flat plate 17 in which has been formed a raised, flexible portion 18 which overlies an opening 19 in the male member defined by a three sided cutout comprising straight sides **19*a* and 19*b* and curved side 19*c*. Edge 18*a* connects flexible portion 18 with plate 17 and is reduced in thickness to provide for flexing movement of portion 18 relative to plate 17. The remaining three edges of portion 18 conform in shape with the sides of opening 19 and edge 18*c* is somewhat shorter than side 19*c* to permit edge 18*c* to move into opening 19 (see FIG. 6). The opening 19 divides plate 17 into rigid sides 17*a* and 17*b* and rigid end 17*c* surrounding opening 19; the rigid end 17*c* providing the locking bar for the buckle. The lower surface of the flexible portion 18 carries a straight bead 20** which is used to release the buckle as will later be described.

Female member 12 comprises a front, outside plate 26 spaced from back inside plate 27 by side walls 28 and 29 extending along the sides of the plates to form a slot 30 between the plates. Front plate 26 contains a cutout 31 similar in shape to and slightly larger than the opening 19 in the male member 11. The cutout 31 permits access to the male flexible part 18 after the male member is inserted into the female member to the locking position of FIGS. 1 and 5. A flexible female part 32 in back plate 27 is located over opening 33 in plate 27 formed by a three sided cutout. Part 32 has straight side edges **32*e* and 32*b* and a curved edge 32*c* which has the same shape as curved side 19*c* of locking bar 17*c* but is slightly shorter. An edge projection 32*d* projects from edge 32*c* flexible portion 32 and when the buckle is locked, edge 32*c* is maintained opposite the side 19*c* of bar 17*c* of male member 11 by projection 32*d*. Edges 32a of portion 32 is reduced in thickness to permit flexing movement of female part 32 relative to plate 27 into opening 33. Cutouts 31 and 33 form plate sections 26*a* and 27*a*, respectively, which are separated by slot 30. Plates 26 and 27 contain openings 35 and 36, respectively, which form bars 26*b* and 27*b* at the end of the buckle also separated by slot 30** and the openings define a passage completely through the female member.

Figure 5:
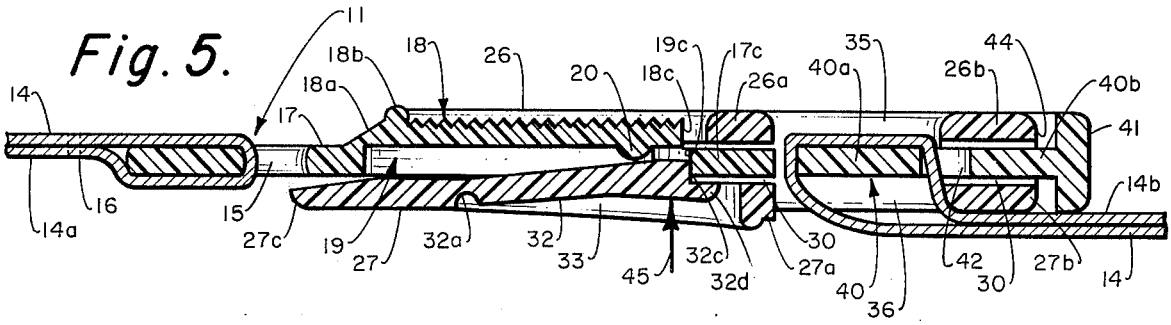
FIG. 5 is a vertical section along line 5—5 of FIG. 1 showing the rigid male part locked in engagement with the flexible female part.

An attaching member 40 extends through slot 30 and contains a rectangular slot 42. In order to attach loose end **14*b* of belt 14, the end is inserted up through opening 36, around end 40*a* of member 40, through slot 42 and out past bar 27*b*. A handle 41 is attached to edge 40*b* of member 40 for moving slot 42 relative to openings 35 and 36. In the unlocking position of the handle, it is pushed forward into cutouts 44 in edges of bars 26*a* and 27*a* so that the end 14*b* of the strap is free to move through slot 42 in order to adjust the length of the belt 14. When tension is placed on the belt, member 40 moves toward bars 26b and 27b and the strap is locked between end 40a of member 40 and bar 27b of plate 27, as illustrated in FIGS. 1 and 5. To loosen the strap, it is only necessary to push handle 41 into cutouts 44 which moves slot 42 away from bar 27b and permits the length of the strap 14** to be adjusted.

Figure 4:
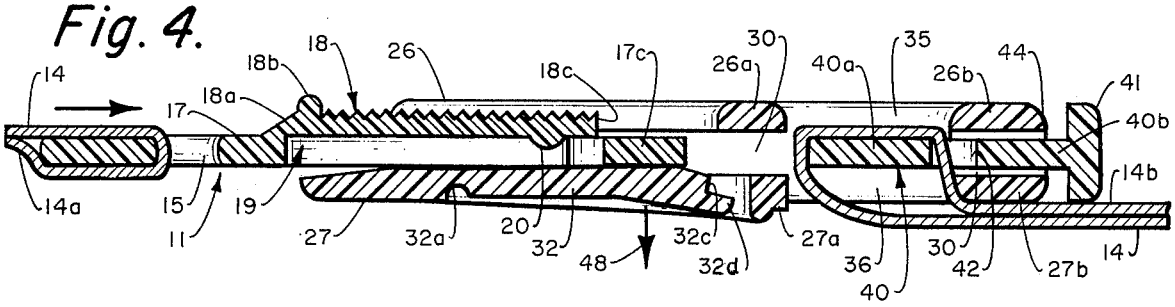
FIG. 4 is a vertical section of FIG. 1 showing the male member being inserted into the female member.

In order to assemble the buckle, the male member is inserted into slot 30 of the female member until the rigid bar 17c is opposite the edge 32c of flexible female part 32 and end 17c is located between plate sections 26a and 27a. During insertion, the bar 17c flexes the female part 32 downwardly in the direction of arrow 48 (see FIG. 4). When bar 17c reaches locked position as illustrated in FIG. 5, part 32 will move toward bar 17c and projection 32d will limit such movement if it should engage the bar. Thereafter, the male and female members are locked together since a pull on opposite ends of belt 14 will be resisted by edge 32c engaging locking bar 17c. Further movement of bar 17c into the female member is prevented when the two corners 11a of male member 11 engage walls 28 and 29. The locking of the buckle does not prevent adjustment of its length since end 17c does not interfere with movement of locking plate member 40. During the time the buckle is locked, the flexible female part 32 resists movement against unlocking since it normally produces an opposing force in the direction of arrow 45 (see FIG. 5). In the unstressed position of part 32, the projection 32d is preferably located adjacent the surface of bar 17c so that if bar 17c is pushed beyond edge 32c it can return without engaging projection 32d. However, if such engagement should occur, the rounded edges of bar 17a and projection 32d will cause projection 32d to move underneath the bar 17c.

Figure 6:
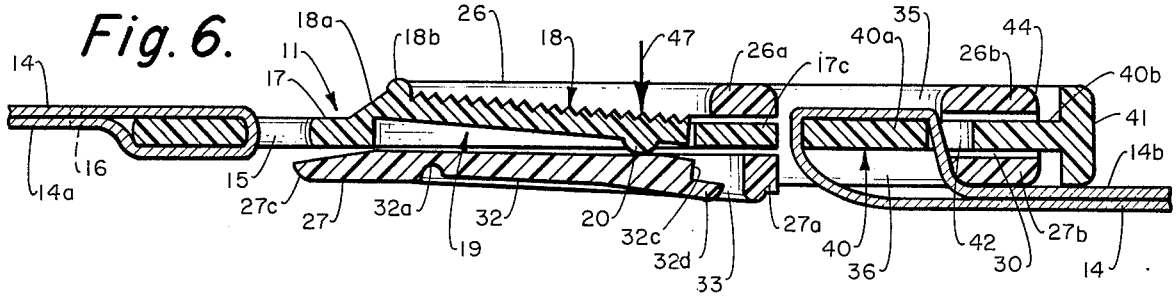
FIG. 6 is a vertical section similar to FIG. 5 showing the flexible male part depressed to unlock the flexible female part from the rigid male part.
Figure 2:
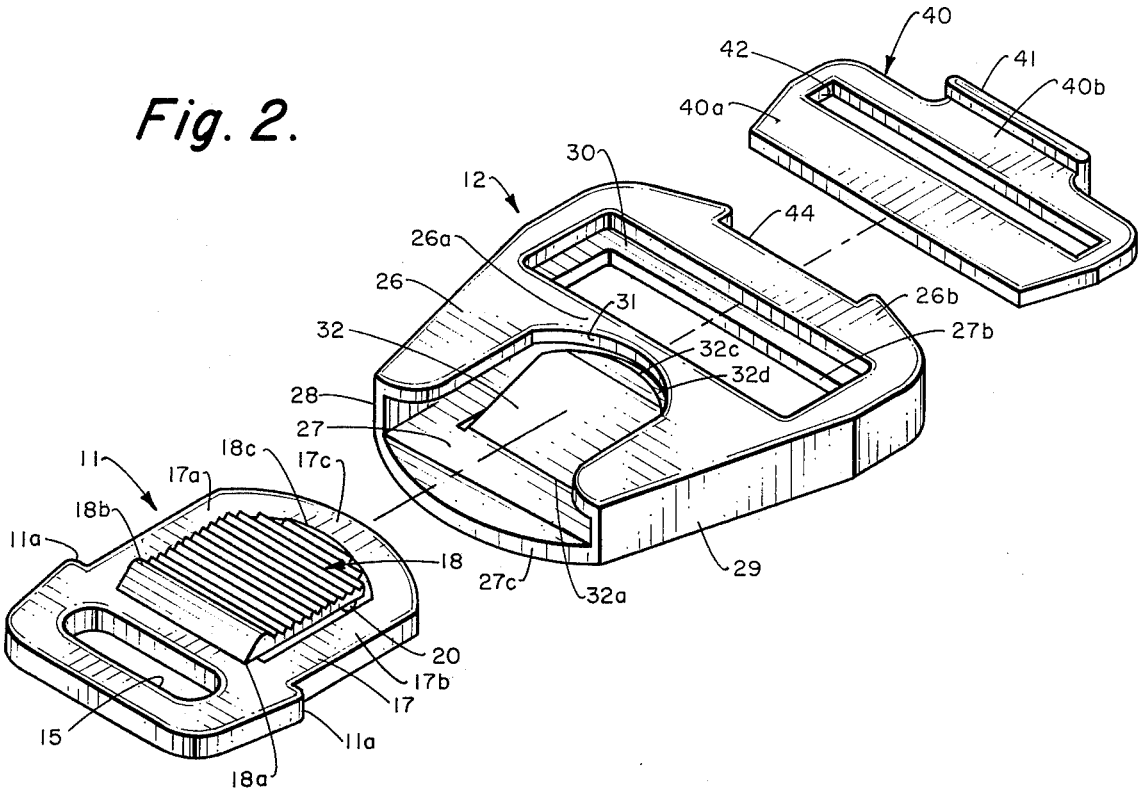
FIG. 2 is an exploded perspective view of the front side of the buckle showing the male and female members.
Figure 3:
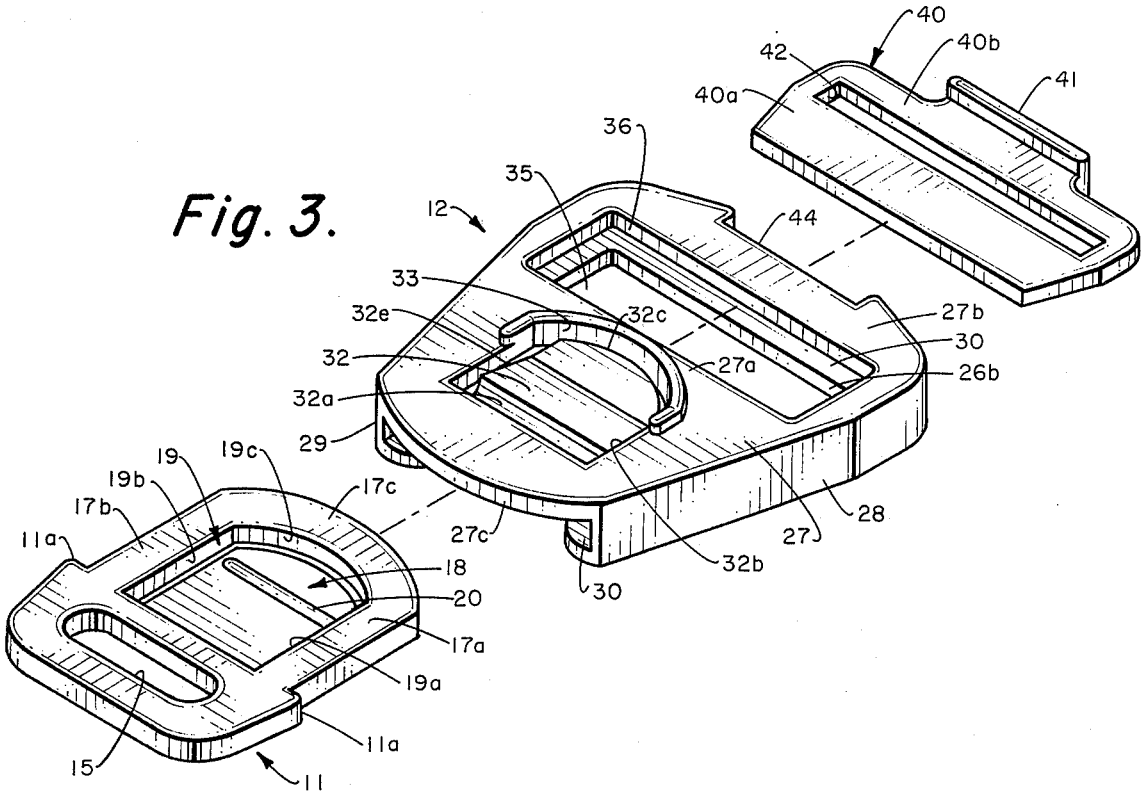
FIG. 3 is an exploded perspective view of the back side of the buckle.

When it is desired to release the buckle, pressure is applied to flexible male portion 18 at arrow 47, causing straight bead 20 to engage the top surface of female part 32 and move part 32 until edge 32c clears bar 17c of the male member (see FIG. 6). Thereafter, the male member can be pulled out of the female member while applying pressure to portion 18 until bar 17c has moved past edge 32c. Upon attachment of the male member to the female member, it is only necessary to push the male member into the female member and it is not necessary to depress any part of either member. A ridge 18b is located along the top of flexible portion 18 to prevent insertion of the male member into the female member if the male member is upside down. In this event, ridge 18b will engage edge 27c of plate 27 and prevent further insertion of the male member.

When the buckle members are attached as illustrated in FIG. 5, it is apparent that flexible member 18 will provide a cover for flexible part 32 of the female member and protect it from accidental exterior forces which would unlock the buckle. Also, any accidental force on the back surface of part 32 would be in a direction to maintain the buckle connection. If the wearer of the belt jumps into a body of water, the impact pressure would be applied to flexible member 18 rather than to the part 32 and any impact pressure between the buckle and the wearer's body would be in a direction to maintain the lock connection.

It is apparent that the present invention utilizes a separate flexible portion of the male member as the buckle latch and that the engaging portions consist of a rigid bar on the male member and a flexible part of the female member. Since the latch is a part of the male member, the cost of producing the entire buckle is substantially less than when a latch separate from the male and female members is utilized.

What is claimed is:

1. A buckle for securing together two objects;
a male member connected to one of said objects and a female member connected to the other of said objects;
said male member having a first cutout;
a male flexible portion located over said first cutout and hinged to one side of said cutout for movement in said cutout;
a rigid locking bar located at another side of said cutout;
said female member having a second cutout;
a female flexible part located over said second cutout and hinged to one edge of said second cutout for movement in said second cutout;
said female flexible part having a bar engaging edge located opposite said locking bar when said members are in position to lock said buckle, said female part being moved by said flexible male portion to move said engaging edge away from said locking bar.

2. A buckle as defined in claim 1;
said engaging edge having a projection thereon for contacting said locking bar and maintaining said edge opposite said locking bar when said members are in the locked position.

3. A buckle as defined in claim 1;
said female member comprising front and back plates having a slot therebetween for guiding the insertion of said male member into said female member, said locking bar being moved in said slot past said engaging edge into buckle locking position.

4. A buckle as defined in claim 3 wherein said objects comprise the ends of a belt;
opposite openings in said front and back plates;
an attaching member inserted through said slot and into a passage formed by said opening;
a belt slot in said attaching member; and
one end of said belt being passed around one end of said attaching member and through said belt slot so that movement of said attaching member binds said belt end between said attaching member and at least one of said plates of said female member and thereby maintains the length of the belt.

5. A buckle as defined in claim 4;
a handle on another end of said attaching member for moving said belt slot in said passage to permit adjustment of belt length.

6. A buckle for securing together the two ends of a belt comprising;
a male member connected to one end of the belt and a female member attachable to the other end of the belt;
said male member comprising a plate having an opening therein and a rigid locking bar at one side of said opening;
a flexible male portion located over said opening and hinged to said male member at an edge of said opening opposite said bar;
said female member comprising front and back plates spaced apart to form a slot therebetween;
said front plate having a cutout for access to said male flexible portion;
a cutout in said back plate;
a female flexible part located over said cutout and hinged to said back plate at an edge of said cutout;

an edge of said female part opposite said hinge edge for engaging said bar and locking said buckle;

said male flexible portion overlying said female flexible part when said members are in locked position with said rigid bar opposite said engaging edge; and downward movement of said flexible male portion moving said engaging edge of said female flexible part away from said rigid bar to permit said male member to be removed from said female member.

7. A buckle as defined in claim 6; a projection on said engaging edge of said female flexible part for engagement with said bar and holding said engaging edge opposite said bar after said male member is inserted through said slot into locking position.

8. A buckle as defined in claim 6; opposite openings in said front and back plates providing a passage through said female member;

an attaching member inserted through said slot and into said passage;

a belt slot in said attaching member; and one end of said belt being passed around one end of said attaching member and through said belt slot so that movement of said attaching member binds said belt end between said attaching member and at least one of said plates of said female member and thereby maintains the length of the belt.

9. A buckle as defined in claim 8;

a handle on another end of said attaching member for moving said belt slot in said passage to permit adjustment of belt length.

* * * * *